US008904603B1

(12) United States Patent
Samuels

(10) Patent No.: US 8,904,603 B1
(45) Date of Patent: Dec. 9, 2014

(54) UNIVERSAL CONNECTOR DEVICE

(71) Applicant: North Coast Medical, Inc., Gilroy, CA (US)

(72) Inventor: Stephen Samuels, San Jose, CA (US)

(73) Assignee: North Coast Medical, Inc., Gilroy, CA (US)

( * ) Notice: Subject to any disclaimer, the term of this patent is extended or adjusted under 35 U.S.C. 154(b) by 0 days.

(21) Appl. No.: 14/306,788

(22) Filed: Jun. 17, 2014

Related U.S. Application Data

(63) Continuation-in-part of application No. 14/067,046, filed on Oct. 30, 2013, now Pat. No. 8,782,854.

(51) Int. Cl.
*E05B 1/00* (2006.01)
*A63B 21/055* (2006.01)

(52) U.S. Cl.
CPC ..... *A63B 21/055* (2013.01)
USPC ..... 16/428; 24/115 R; 482/126; 482/139

(58) Field of Classification Search
USPC ..... 16/110.1, 421, 422, 428, 430, 431, 444, 16/445; 24/115 R, 115 H, 122.6; 482/122, 482/126, 129, 138, 139
See application file for complete search history.

(56) References Cited

U.S. PATENT DOCUMENTS

| | | | |
|---|---|---|---|
| 1,746,759 | A | 2/1930 | Baker |
| 1,965,511 | A | 7/1934 | Preston |
| 2,565,605 | A | 8/1951 | Grayson |
| 2,634,474 | A | 4/1953 | Grayson |
| 3,481,302 | A | 12/1969 | Horgan |
| 3,528,656 | A | 9/1970 | Haanen |
| 4,257,592 | A | 3/1981 | Jones |
| 4,348,974 | A | 9/1982 | Lerner |
| 4,762,318 | A | 8/1988 | Phillips et al. |
| 5,533,952 | A | 7/1996 | Schaber |
| 5,885,196 | A | 3/1999 | Gvoich |
| 6,047,930 | A | 4/2000 | Bello |
| 6,151,758 | A | 11/2000 | Chiu |
| 6,170,783 | B1 | 1/2001 | Bello |
| 6,398,698 | B1 | 6/2002 | Hinds |
| 6,497,641 | B1 | 12/2002 | Hinds |
| 6,648,804 | B2 | 11/2003 | Chen |
| 6,663,544 | B2 | 12/2003 | Hinds |
| 6,692,415 | B1 | 2/2004 | Winston |
| 6,866,617 | B2 | 3/2005 | Chen |
| 6,923,750 | B1 | 8/2005 | Hinds |

(Continued)

*Primary Examiner* — William Miller
(74) *Attorney, Agent, or Firm* — Bay Area Technology Law Group PC

(57) ABSTRACT

A connector device is disclosed for releasably connecting a cord or flexible tube which includes a disk-shaped top plate which has an exit opening for the end of a cord to be retained. A capture cap has a circumferential edge which mates with the top plate. The top plate has a series of indents upon its circumferential edge. A capstan is located between the top plate and capture plate. A cord or flexible tube to be connected is directed through an opening where it enters a helical track in the capture cap. When the capture cap is rotated in a first direction the cord is wrapped around the capstan and captured within the helical track. Rotation in the opposite direction releases the cord. A ratchet capture and release mechanism engages the series of indents to further prevent release of the cord. A retaining device is secured to the top plate for attaching the connector device in a fixed position thereby attaching the cord. Multiple connector devices connect multiple cords or flexible tubes together.

12 Claims, 9 Drawing Sheets

(56) References Cited

U.S. PATENT DOCUMENTS

| | | | |
|---|---|---|---|
| 7,147,592 | B2 | 12/2006 | Hinds et al. |
| 7,316,636 | B1 | 1/2008 | Hinds et al. |
| 7,473,213 | B1 | 1/2009 | Kallenbach |
| 7,625,324 | B1 | 12/2009 | Hinds et al. |
| 8,096,024 | B2 | 1/2012 | Smith et al. |
| 2013/0288864 | A1 | 10/2013 | Holland |

UNIVERSAL CONNECTOR DEVICE

RELATED APPLICATION

This patent application is a continuation-in-part of U.S. patent application Ser. No. 14/067,046, now, U.S. Pat. No. 8,782,854 entitled Universal Handle Device filed on Oct. 30, 2013.

TECHNICAL FIELD OF INVENTION

The present invention relates to a universal connector device for releasably gripping and connecting various sizes of cords, tubes, cloth, elastic, compliant or stretchable cords and tubes and other media.

BACKGROUND OF THE INVENTION

Various devices have been devised to attach a rope to a fixed position or to another rope. One such device is a capstan. The tension on a line wrapped around a capstan (or bollard or winch) may be different on either side of the capstan. A small holding force exerted on one side can carry a much larger force on the other side. This is the principle by which a capstan-type device operates. For instance in rock climbing with so-called top-roping, a lighter person can hold or belay a heavier person due to this effect. But by itself a capstan can't hold a rope in place, let alone an elastic or pliable rope or cord.

Other devices rely on driving lines, ropes or wires into shallower and shallower recesses or along increasing enclosed inclined planes. Still others use abutting openings which are then misaligned to constrict wire movement. But none of these devices can securely attach a rope or cord, particularly where the cord has elastic or compliant properties and is subject to repetitious, cyclic or oscillating forces. As used herein compliant means temporarily deformable or non-rigid.

Thus an object of the present invention is to provide a universal connector device which reliably connects a rope, cord or elastic material to a surface or an object or to another connector device.

Yet a further object of the present invention is to provide a device in which a cord, band, rope, elastic rope or cloth can be selectively detached from and attached to other such cords, bands, ropes or cloth.

Another object of the invention is to securely attach elastic or compliant ropes or cords to a surface, a fastener or another rope or cord.

Another object of the invention is to securely fix and hold elastic or compliant cords which are subject to repetitious, cyclic or oscillating forces.

These and further object be more readily apparent when considering the following disclosure and appended claims.

SUMMARY OF INVENTION

A connector device releasably and securely retains a cord or flexible tube. It includes a top plate having a generally disk shape with a central opening and having an exit opening for the end of a cord or flexible tube to be retained and has a retaining device secured to the top plate for attaching the connector device in a fixed position.

The connector device further has a capture cap having circumferential edge which mates with the top plate, the top plate further has a series of indents upon its circumferential edge, a central capstan between the top plate and the capture cap which may fit into the central opening of the top plate, and has an entrance opening for receipt of the cord or flexible tube to be retained.

A helical track is formed in the capture cap, the helical track being sized and positioned to receive the cord or flexible tube at the entrance opening. The cord or flexible tube is lockably retained in the helical track and around the capstan surface upon rotation of the capture cap in a first direction and removable from the helical track and capstan surface upon rotation of the capture cap in a second direction.

A ratchet capture and release mechanism engages the series of indents in which, in a first orientation, the capture cap is prevented from rotating with respect to the top plate and when in a second orientation, the capture cap is capable of so rotating. The fastening device can be many different fasteners such as a hook or a loop. That is, a cord or flexible tube is secured to the connector device which may then be attached to a suitable surface or location.

In another aspect of the invention two or more connector devices are mated together thereby connecting two or more cords or flexible tubes together. In one embodiment the mating device is a rod connecting two connector devices. In another embodiment a link, ring or clip mates two or more connector devices together.

DETAILED DESCRIPTION OF THE INVENTION

Figure 1:
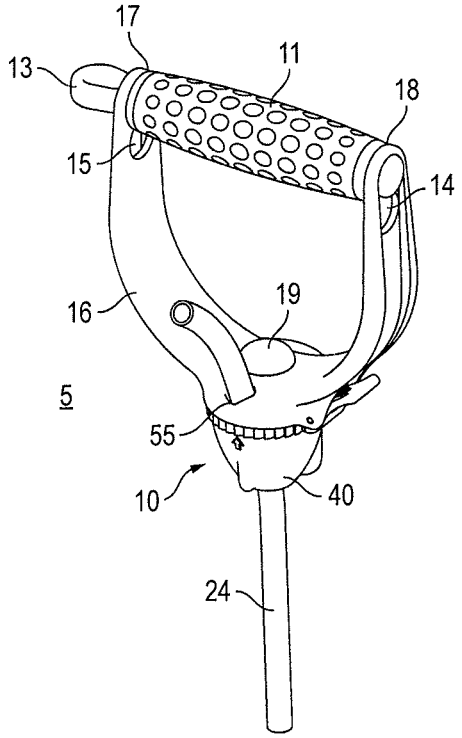
FIG. 1 is a perspective view of the universal connector device of the present invention utilizing a handle support together with a cord or flexible tube retained therein.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of the other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

This patent application is a continuation-in-part of U.S. patent application Ser. No. 14/067,046 entitled Universal Handle Device filed on Oct. 30, 2013. This parent application is directed to a universal handle device for gripping various sizes of cords, tubes, or cloth and in particular, stretchable cords and tubes used in an exercise device. While the parent case is directed to an exercise device it describes a unique connector structure. Because of this the following description relating to FIGS. 1-5 are re-iterated in part below.

In FIG. 1, an exercise device 5 is depicted which includes an improved connector device 10 for releasably connecting a cord or flexible tube 24. It is noted that throughout this disclosure, element 24 is described as a cord or flexible tube although it should be understood that element 24 can also include rope, elastic rope, compliant materials, woven or unwoven cloth and other linear media segments which will not be specifically referred to for the sake of expediency.

Turning once again to FIG. 1, device 5 further includes U-shaped yoke 16 having terminal ends 17 and 18 and midpoint 19 therebetween.

Openings 14 and 15 are positioned proximate terminal ends 17 and 18. Handle 11 is sized for gripping by the hand of the user, handle 11 having first and second ends 12 and 13 being sized for receipt by openings 14 and 15 knowing that openings 14 and 15 are ideally in the form of eyelets having an expanded portion for receiving handle 11 which, when slid towards terminal ends 17 and 18, would be rotatably captured thereby thus preventing handle 11 from inadvertently being released by yoke 16.

Figure 2:
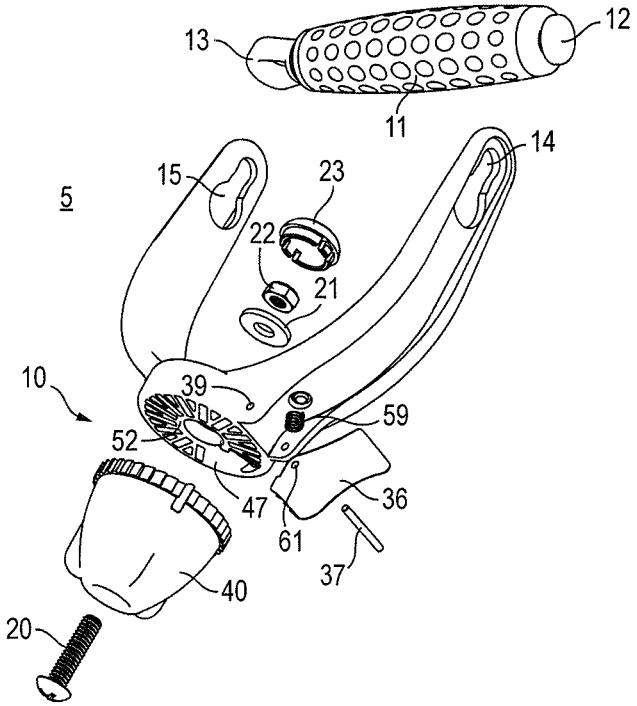
FIG. 2 is an exploded view of the universal connector device of FIG. 1.
Figure 5:
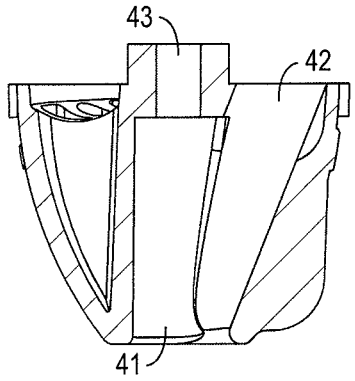
FIG. 5 is a cross section of the capture cap of FIG. 4 taken along line 5-5.

As noted in reference to FIG. 2, capture cap 40 is appended to yoke 16 by use of retention bolt 20 received by open end 41 and passage way 43 formed in capstan 44 (FIG. 5). Bolt 20 is maintained in position by retention washer 21 and retention nut 22. Cap 23 completes the assembly enabling capture cap 40 to remain appended to yoke 15 in a rotatable relationship.

Turning once again to handle 11, it is noted that end 13 is in the form of a loop, the reason for which will become apparent in the disclosure which follows.

Figure 4:
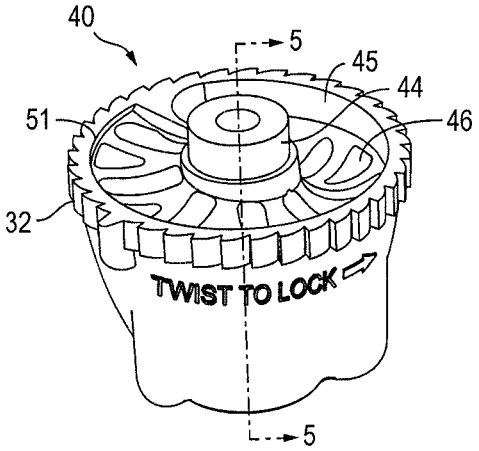
FIG. 4 is a perspective view of the capture cap of the present invention employed as an important part thereof.

As noted above, an essential structural component of the present invention is in the form of capture cap 40, the internal details of which can best be appreciated by additionally referring to FIGS. 4 and 5. Capture cap 40 is received by yoke 16 at its mid-point having a circumferential edge 51 abutting yoke 16 at opening 52. Yoke 16 serves as a top plate opposing or mating with capture cap 40. A helical passage 45 extends along the inside wall of the capture cap 40. Flanges 46 along the helical passageway (FIG. 4) and flanges 47 along the bottom surface of the yoke 16 around the opening 52, result from the fabrication process. Cord or flexible tube 24 enters opening 41 where it enters helical passage 45 and exits capture cap 40 at opening 55. There it is in a position to be wrapped around capstan 44.

In operation, if capture cap 40 is then twisted in a counterclock wise direction, yoke 16 forces the cord or flexible tube along the helical passage and around capstan 44 until it is securely locked down or wedged between the capture cap 40, yoke or top plate 16 and capstan 44, thereby preventing it from release from connector device 10. More particularly, the twisting of the cord or flexible tube along the helical passageway 45 and around capstan 44 provides secure engagement of the cord or flexible tube, even when the cord or flexible tube is elastic or compliant. Further, the cord or flexible tube remains secure even when the cord or flexible tube is subject to repetitious, cyclic or oscillating forces.

As noted in reference to FIG. 5, passage 42 is in communication with opening 41 such that cord or flexible tube 24 passes within channel 42, again, to exit yoke 16 at opening 55.

As a safety measure and to prevent inadvertent release of cord or flexible tube 24 from device 10, capture cap 40 is provided with a series of indents 32 and a corresponding ratcheting safety release mechanism 36 which, when in a first orientation engages said series of indents 32 preventing capture cap 40 from rotating and thus maintaining cord or flexible tube 24 in locking engagement within helical channel 45. Ratchet safety capture and release mechanism 36 pivots about pin 37 biased by spring 59, and is maintained in place as pivot pin 37 passes within openings 39 of yoke 16 as well as through opening 61 of ratchet safety capture and release mechanism 36 as shown. When cord or flexible tube 24 is to be released from device 10, ratchet safety capture and release mechanism 36 is engaged by a thumb or finger of a user in applying pressure against spring 59 to remove its contact with the series of indents 32 thus enabling capture cap to rotate in a clockwise direction enabling cord or flexible tube 24 to be released and removed from device 10 by pulling it away from capture cap 40.

As noted in reference to FIG. 1 the longitudinal axis of cord or flexible tube 24 is substantially perpendicular to the longitudinal axis of handle 11, an orientation which is traditionally seen as that of a handle/cord combination. However, where the universal connector device is used in exercising applications there are exercises and rehabilitative routines which would be more ideally carried out if cord or flexible tube 24 was to be oriented parallel to handle 11 as an alternative. In this regard, reference made to FIG. 3.

Figure 3:
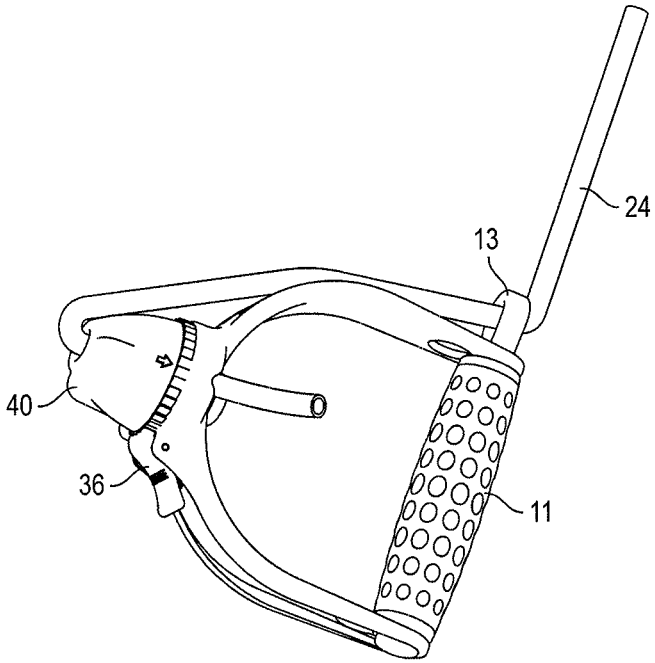
FIG. 3 is yet another perspective view of the universal connector device of the present invention with said cord or flexible tube being routed in an alternative orientation to that of FIG. 1.

Turning to FIG. 3, cord or flexible tube 24, emanating from capture cap 40 is caused to pass through loop 13 in sliding engagement therewith. Thus, the longitudinal axis of cord or flexible tube 24 is substantially parallel to the longitudinal axis of handle 11 adding to the universal nature of the present invention.

In accordance with other embodiments of the invention connector device 10 includes a retaining device so that the connector device, and hence, the cord or flexible tube, can be attached at any desired location or position. For example, the retaining device may be attached to a surface such as a wall, to a pole, to a vehicle, another connector device of the present invention or wherever one desires to attach a cord or flexible tube.

FIGS. 6-12 illustrate the improved connector of the present invention independent and apart from the exercise device 5 of FIGS. 1-5. In the following description of FIGS. 6-13 element numbers which correspond to those used to describe elements of the connection device 10 forming a part of the exercise device 5 of FIGS. 1-5 are repeated with respect to the connector devices shown in the following FIGS. 6-12.

Figure 6:
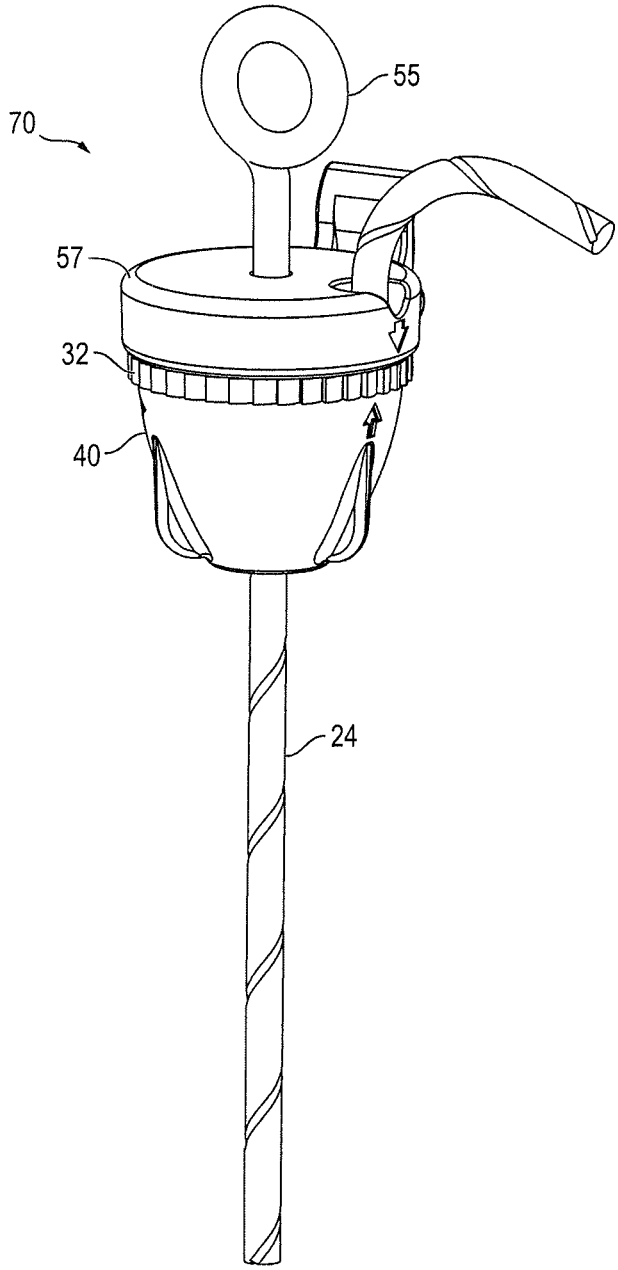
FIG. 6 is a perspective view of the universal connector which illustrates a loop or eyelet to retain the connector with a cord or flexible tube attached therein.

FIG. 6 shows a connector device 70 with a retaining device in the form of a loop or eyelet 55 attached to top plate 57. The top plate 57 serves a similar function as yoke 16 in FIGS. 1-5 to guide and force the cord or flexible tube along helical passage 45 and around capstan 44. Loop 10 in turn can be attached to a hook, buckle, chain, other retaining device or wherever the user desires to attach cord or flexible tube 24.

Figure 7:
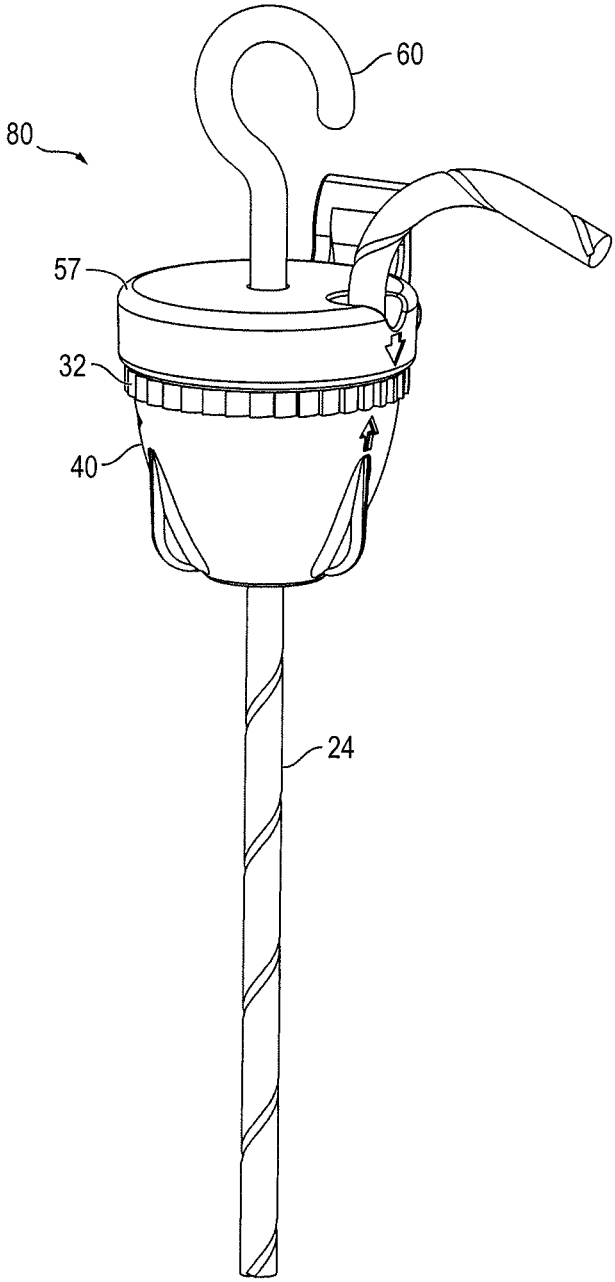
FIG. 7 is a perspective view of the universal connector which illustrates a hook to retain the connector with a cord or flexible tube attached therein.

FIG. 7 is a perspective view of a retaining device 80 having a hook 60 attached to the top plate 57. In this embodiment a cord or flexible tube 24 can be hooked to anything that a user desires.

Figure 8:
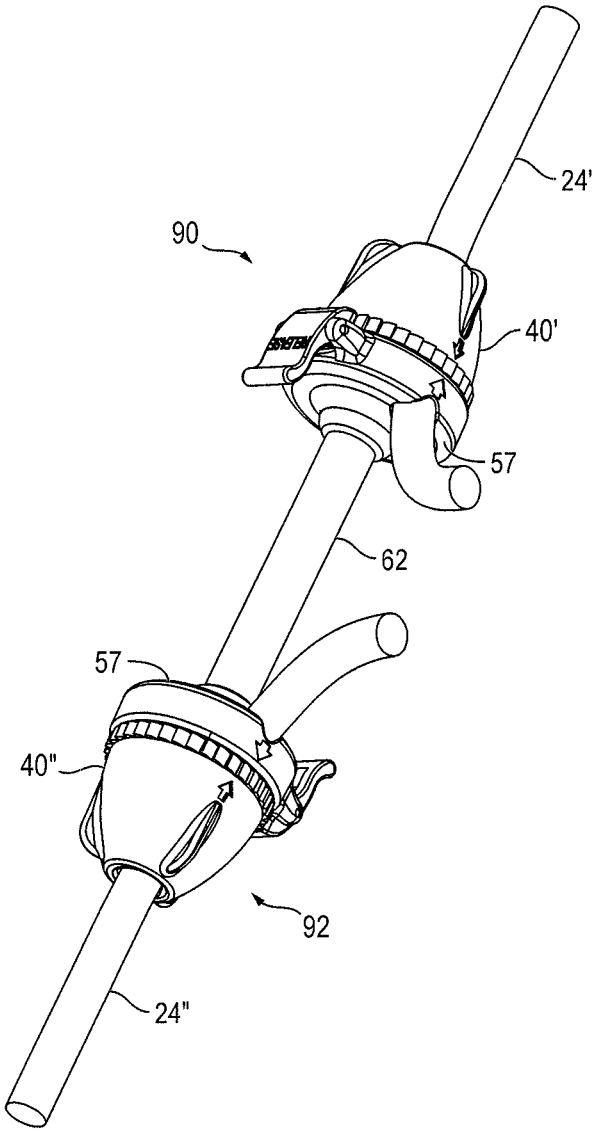
FIG. 8 is a perspective view of the universal connector which illustrates an embodiment where a pair of connectors are secured together to attach cords or flexible tubes together.

FIG. 8 shows multiple connector devices 90 and 92 formed as a unitary structure to connect multiple cords or flexible tubing together, in this case two cords or flexible tubing 24' and 24". In this case a mating structure or device is a solid rod 62 connected at one end to top plate 57 of connector 10' and the other end to the top plate 57 of connector 40".

Figure 9A:
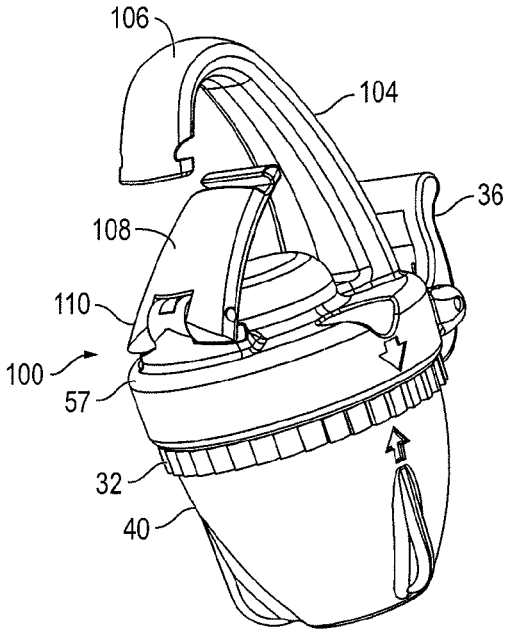
FIGS. 9A-9D illustrate another embodiment of the present invention where connector devices of the invention are provided with fasteners in the form of spring clips.
Figure 9B:
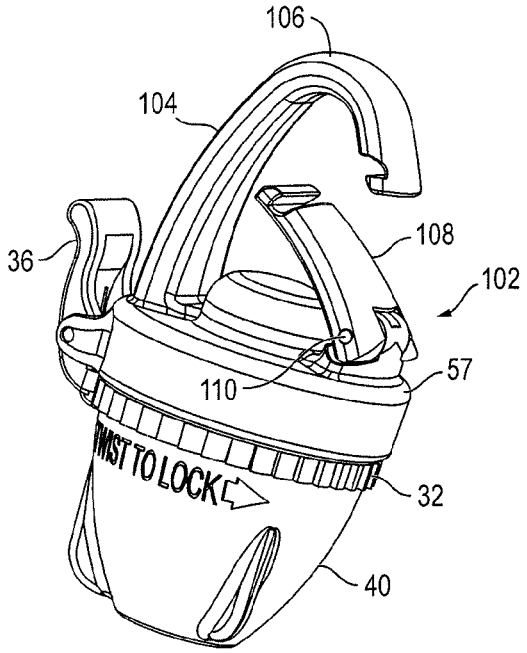
Figure 9C:
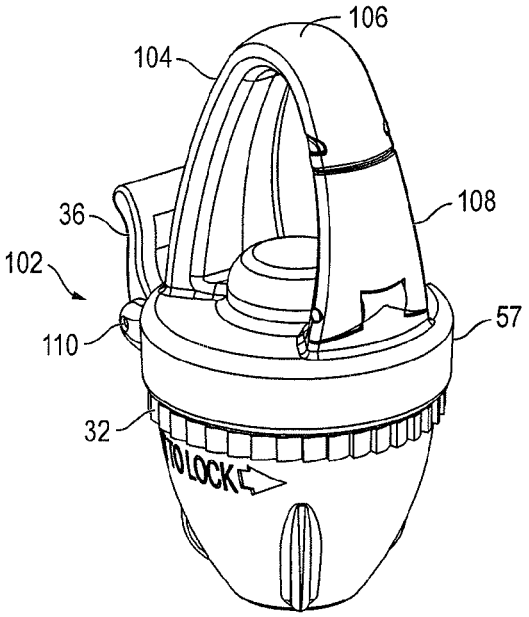
Figure 9D:
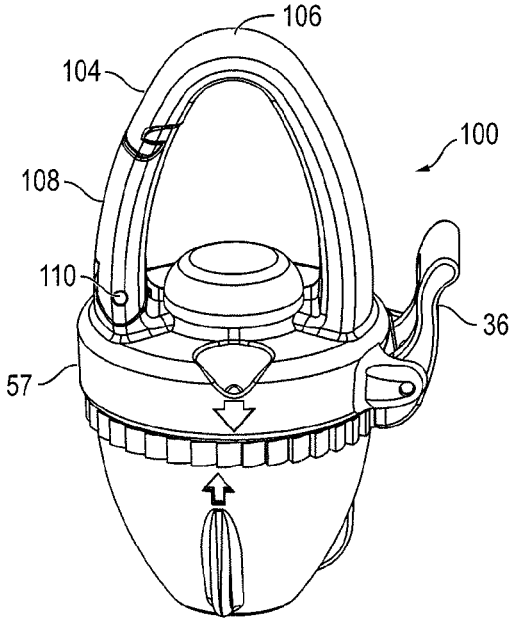

FIGS. 9A-9D show another embodiment of the present invention. Here two connector devices 100 and 102 are shown in perspective. For clarity the retained cords and flexible tubing are not shown in these figures as well as in FIGS. 10-12. It should be understood that the operation of the connectors shown in these figures is identical with that previously described herein. In this embodiment each of the connector devices 100 and 102 are provided with a spring clip assembly 104 affixed to the top plate 57. Each spring clip assembly includes a fixed hook 106 and a mating clip 108 which is spring biased at pivot 110. To clip the connector devices 100 and 102 the spring clips 108 are pivoted inwardly as shown in FIGS. 9A and 9B. When the spring clips are released the spring clip assembly forms an uninterrupted loop as shown in FIGS. 9C and 9D.

Figure 10:
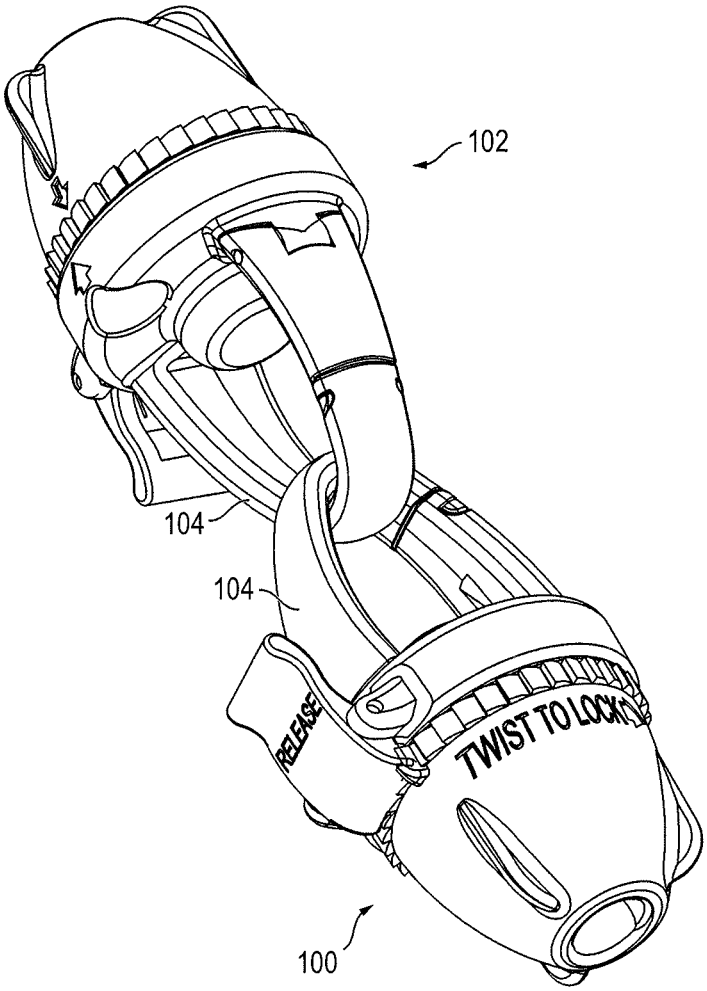
FIG. 10 illustrates the connector devices of FIGS. 9A-9B clipped together to fasten two cords or flexible tubing together.

Connector devices 100 and 102 can be connected together as shown in FIG. 10. In this way two cords or flexible tubing can be connected together using two connector devices 100 and 102. The invention is not limited to attaching only two cords or flexible tubing together. For example, in the embodiment of FIG. 10 additional retaining devices 100 and 102 can be clipped directly together to attach multiple cords or flexible tubes together.

Figure 11:
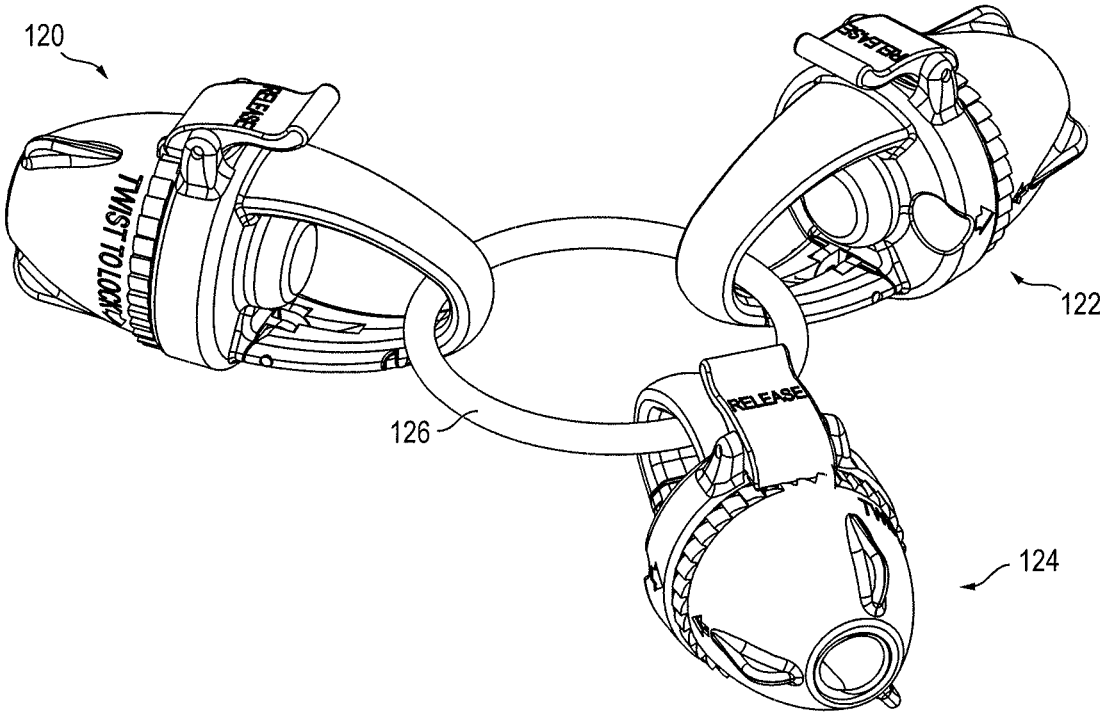
FIG. 11 is a prospective view.
Figure 12:
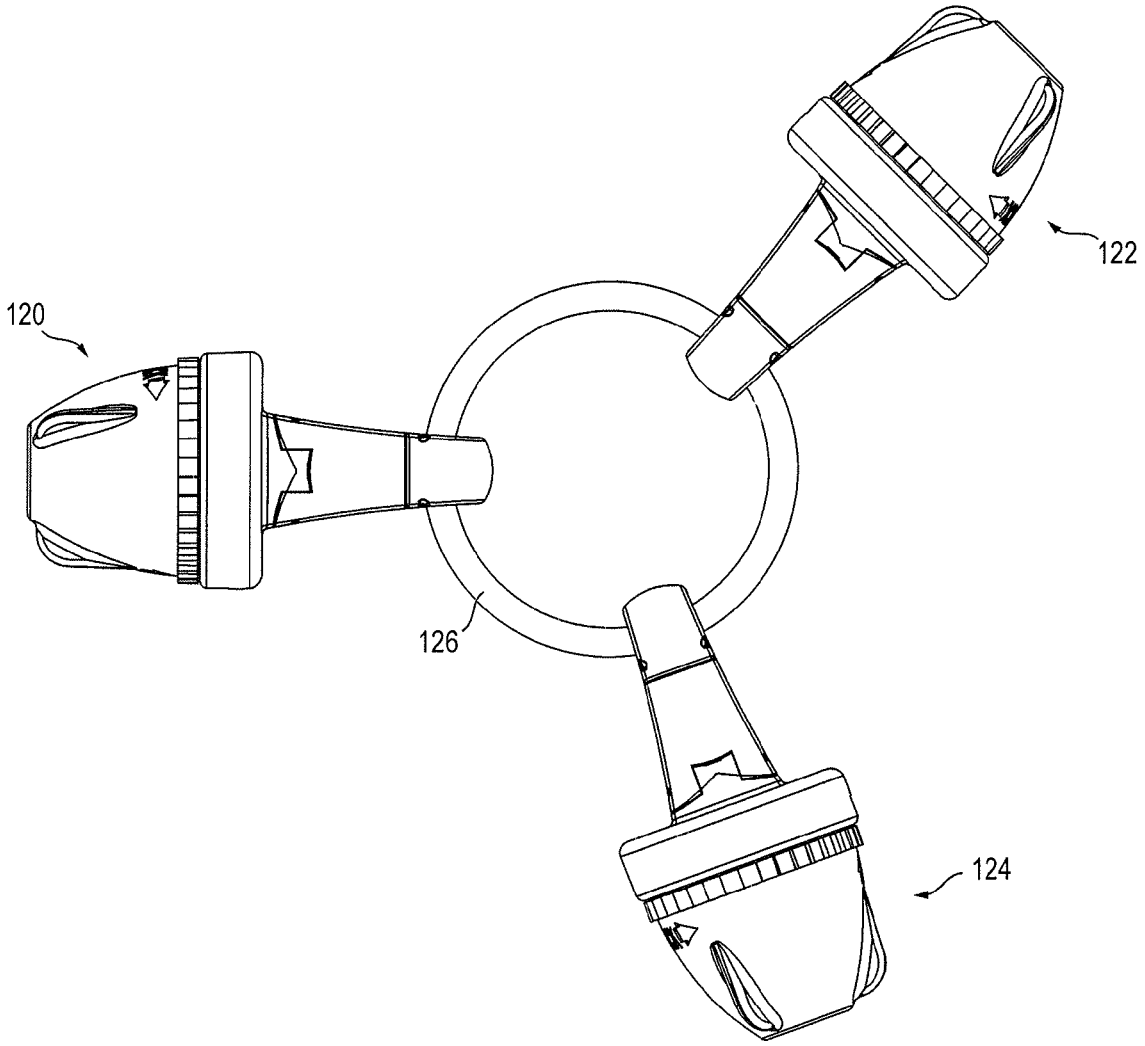
FIG. 12 is a top view of another embodiment of the invention having multiple connectors for attaching multiple cords or flexible tubing together.

FIGS. 11 and 12 illustrate another embodiment for attaching multiple cords or flexible tubing together. FIG. 11 is a perspective view and FIG. 12 is a top view of an embodiment illustrating the use of three spring clip retaining devices 120, 122 and 124, each of which is clipped onto a ring 126. Of course, this embodiment is not limited to securing three cords or flexible tubes together. Any number of spring clip retaining devices can be clipped to ring 126 depending upon the ring size.

In summary the present invention discloses for the first time a device which can interchangeably receive and releasable capture cords and flexible tubing of various resistances. Importantly, a cord or flexible tubing captured is held and captured in such a manner that it can't work its way out of the connector due to oscillating or variable tension over time. Further it functions to fix and hold a variety of media including elastic tubes and materials.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions changes and equivalents will readily occur to those skilled in the art and may be employed as suitable without departing from the true spirit and scope of the invention. Such changes might involved alternative materials, components, structural arrangements, sizes, shapes, forms, functions, operational features or the like. Therefore, the above description and illustration should not be considered as limiting the scope of the invention, which is defined by the appended claims.

What is claimed is:

1. A connector device for releasably connecting a cord or flexible tube comprising:

a top plate having a generally disk shape with a central opening;

the top plate further having an exit opening for the end of the cord or flexible tube to be retained;

a capture cap having circumferential edge which mates with the top plate, the top plate further having a series of indents upon its circumferential edge and having an entrance opening for receipt of the cord or flexible tube to be retained;

a central capstan which fits into the central opening of the top plate;

a helical track formed in the capture cap, the helical track being sized and positioned to receive the cord or flexible tube at the entrance opening, the cord or flexible to being lockably retained in the helical track and around the capstan upon rotation of the capture cap in a first direction and removable from the helical track and capstan upon rotation of the capture cap in a second direction;

a ratcheted capture and release mechanism engaging the series of indents in which, in a first orientation, the capture cap is prevented from rotating with respect to the top plate and when in a second orientation, the capture cap is capable of so rotating; and a retaining device secured to the top plate for attaching the connector device in a fixed position.

2. The connector device of claim 1 wherein the fastening device comprises a hook.

3. The connector device of claim 1 wherein the fastening device comprises a loop.

4. A connector assembly for releasably connecting and retaining first and second cords or flexible tubing together comprising:

first and second connector devices for connecting respectively the first and second cords or flexible tubing together, each comprising a top plate having a generally disk shape with a central opening;

the top plate further having an exit opening for the end of the cord or flexible tube to be retained;

a capture cap having a circumferential edge which mates with the top plate, the capture cap further having a series of indents upon its circumferential edge and having an entrance opening for receipt of the cord or flexible tube to be retained;

a central capstan which fits into the central opening of the top plate;

a helical track formed in the capture cap, the helical track being sized and positioned to receive the cord or flexible tube at the entrance opening;

wherein the cord or flexible tube is lockably retained in the helical track and wound around the capstan upon rotation of said capture cap in a first direction and removable from the helical track and capstan upon rotation of the capture cap in a second direction;

a ratchet capture and release mechanism engaging the series of indents in which, in a first orientation, the capture cap is prevented from rotating with respect to the top plate and releasing the cord or flexible tubing and when in a second orientation, the capture cap is capable of so rotating in releasing the cord or flexible tubing; and a mating device secured to each of the top plates whereby securing the connector devices together and thereby connecting the first and second cords or flexible tubing together.

5. The connector assembly of claim 4 where in the mating device is a rod.

6. The connector assembly of claim 4 wherein the mating device is a loop.

7. A connector device for releasably retaining an elastic cord subject to cyclical loads comprising:

a top plate having a generally disk shape; the top plate further having an exit opening for the end of the elastic cord to be retained;

a holding device secured to the top plate;

a capture cap having circumferential edge which mates with the top plate and having an entrance opening for receipt of the elastic cord to be retained, the top plate further having a series of indents upon its circumferential edge;

a capstan centrally located between the top plate and the capture cap;

a helical track formed in the capture cap, the helical track being sized and positioned to receive the elastic cord at the entrance opening, the elastic cord being lockably retained on in the helical track and around the capstan upon rotation of the capture cap in a first direction and removable from the helical track and capstan upon rotation of the capture cap in a second direction; and a ratchet capture and release mechanism engaging the series of indents in which, in a first orientation, the capture cap is prevented from rotating with respect to the top plate and when in a second orientation, the capture cap is capable of so rotating.

8. The connector device of claim 7 including means to secure the connector device to another device or surface.

9. A connector assembly for releasably connecting and retaining multiple cords or flexible tubes together comprising:

multiple connector devices for connecting the multiple cords or flexible tubes together, each comprising a top plate having a generally disk shape with a central opening;

the top plate further having an exit opening for the end of the cord or flexible tube to be retained;

a capture cap having a circumferential edge which mates with the top plate, the top plate further having a series of indents upon its circumferential edge and having an entrance opening for the receipt of the cord or flexible tube to be retained;

a central capstan which fits into the central opening of the top plate;

a helical track formed in the capture cap, the helical track being sized and positioned to receive a cord or flexible tube at the entrance opening;

whereby the cord or flexible tube is lockably retained in the helical track and around the capstan upon rotation of the capture cap in a first direction and removable from the helical track and capstan upon rotation of the capture cap in a second direction;

a ratchet capture and release mechanism engaging the series of indents in which, in a first orientation, the capture cap is prevented from rotating with respect to the top cap and releasing the cord or flexible tube and when in a second orientation, the capture cap is capable of so rotating and releasing the cord or flexible tube; and a mating device secured to each of the top plates thereby securing the connector devices together and thereby connecting the multiple cords or flexible tubes together.

10. The connector assembly of claim 9 wherein the mating device is a rod.

11. The connector assembly of claim 9 wherein the mating device is a ring.

12. The connector assembly as in claim 9 wherein the mating device is a spring clip hook.

* * * * *